United States Patent [19]

Nielsen

[11] Patent Number: 5,069,234

[45] Date of Patent: Dec. 3, 1991

[54] APPARATUS FOR TREATING AN EXTERIOR PIPE SURFACE

[75] Inventor: Anders G. Nielsen, Soest, Netherlands

[73] Assignee: Van Voskuilen-Woudenberg B.V., Woudenberg, Netherlands

[21] Appl. No.: 621,310

[22] Filed: Nov. 30, 1990

[30] Foreign Application Priority Data

Sep. 14, 1990 [NL] Netherlands ..... 9002031

[51] Int. Cl.[5] ..... B08B 3/02; B08B 9/02

[52] U.S. Cl. ..... 134/113; 15/88; 15/104.04; 51/165.75; 51/415; 51/429; 118/307; 118/670; 118/DIG. 11; 134/122 R; 134/181

[58] Field of Search ..... 134/113, 122 R, 170, 134/172, 179, 180, 181, 199; 118/307, DIG. 11, 670, 672, 676; 51/415, 426, 428, 429, 165.74, 165.75; 15/88, 104.04

[56] References Cited

U.S. PATENT DOCUMENTS

| | | | |
|---|---|---|---|
| 1,898,964 | 6/1933 | Jinnett | 15/104.04 |
| 2,427,129 | 7/1947 | Fields | 15/104.04 X |
| 3,066,254 | 11/1962 | Price et al. | 15/104.04 X |
| 4,007,705 | 2/1977 | Sherer et al. | 118/307 X |
| 4,677,998 | 9/1987 | Voskuilen et al. | 134/181 |
| 4,953,496 | 9/1990 | Taylor et al. | 118/DIG. 11 |

*Primary Examiner*—Philip R. Coe

*Attorney, Agent, or Firm*—Webb, Burden, Ziesenheim & Webb

[57] ABSTRACT

An apparatus for the treatment of an exterior pipe surface includes one or more nozzles or other treating means which are carried by a frame. The frame can be mounted around the pipe to be treated and is capable of moving along the pipe surface in longitudinal direction thereof, due to the provision of travelling wheels. Disclosed are provisions for allowing the apparatus to keep itself in balance on the pipe during operation. Such provisions include detection means (e.g. a pendulum with sensors) for detecting undesired displacements of the frame in circumferential direction of the pipe, and control means (such as e.g. hydraulic cylinders with a common system of hydraulic lines and valves) for adjusting the wheel axes of one or more travelling wheels in angular position, in response to a signal delivered by the detection means.

5 Claims, 9 Drawing Sheets

APPARATUS FOR TREATING AN EXTERIOR PIPE SURFACE

This invention relates to an apparatus for the treatment of an exterior pipe surface, such as e.g. the removal of a bituminous or other coating from the surface of a pipe, wherein the pipe may have a finite length but also may be a portion of a pipeline.

Pipes in the ground are often provided with an exterior bituminous coating comprising a fibre web impregnated with bituminous material and wound around the pipes. Coatings of polyethylene film applied around the pipes by extrusion from an annular nozzle or by winding are used in other cases. While such bituminous or other coatings will provide sufficient protection against corrosion in their freshly applied state, they may become detached or damaged after some time in consequence of material ageing, plant roots in growth, landslides and the like. Therefore, the pipes should be inspected periodically and as a result thereof, it may sometimes be necessary to remove the coatings from the pipes and replace them by fresh coatings.

It has already been suggested to remove bituminous or other coatings with the aid of powerful water jets directed against the pipe surface. Thus, document U.S. Pat. No. 4677998 discloses an apparatus comprising a frame adapted for mounting around the pipe to be treated and one or more nozzles supplied with pressurized water within that frame. Means are present to move the nozzles in longitudinal as well as circumferential direction along the pipe surface in such a way that the nozzles will describe a zigzag path having the longitudinal direction of the pipe as a main direction.

Documents U.S. Pat. No. 2427129 and U.S. Pat. No. 1898964 disclose apparatuses for cleaning pipelines, i.e. removing rust, scale and paint, with the aid of rotating brushes. The brushes are located within a frame which may be mounted around the pipeline and are moved along the pipeline in circumferential as well as axial direction during operation, due to a special construction.

In most of these prior apparatuses, the means for moving in longitudinal direction consist of travelling wheels carried by the frame, such wheels having axes perpendicular to the longitudinal direction of the pipe and engaging the pipe surface in their operating position. These travelling wheels are sometimes arranged in groups so that the pipe to be treated is more or less enclosed by the wheels. The travelling wheels or at least some of them may be driven directly by means of an engine, but knurled driving rollers having a better grip on the pipe surface than the travelling wheels, may sometimes be present in addition thereto.

While the prior apparatuses for treating a pipe surface are capable of moving by themselves along the pipe to be treated, thanks to the travelling wheel system just described, it is sometimes necessary to keep such apparatuses in balance during operation with the aid of a crane travelling alongside the pipe. An unequal distribution of auxiliary equipment such as hoses and cables, irregularities during movement of the treating means in circumferential direction, inequalities of the pipe surface and moreover, curvatures in the pipe may easily disturb the balance and have a negative effect on functioning of the apparatus. A crane travelling alongside the pipe may provide corrections in the position of the treating apparatus and thus keep the treating apparatus in balance, either by means of a cable which engages the frame of the treating apparatus directly or else by means of a cable engaging a sliding annulus around the pipe and passing between two parallel beams of the frame of the treating apparatus. However, it appears in practice that corrections in the position of the treating apparatus will be effected intermittently in this way, which may lead to serious tensions and even ruptures in the frame of the treating apparatus and moreover, that problems will occur during travel of the crane on uneven ground. Therefore, a need exists for provisions allowing the treating apparatus to keep itself in balance on the pipe to be treated when in operation.

In accordance with the invention, it has now been found that this need can be satisfied by providing the apparatus for treating a pipe surface with means for detecting undesired displacements of the frame in circumferential direction of the pipe, and with control means for adjusting the wheel axes of one or more travelling wheels in angular position, in response to a signal delivered by the detection means. If the wheel axes are adjusted then as soon as an undesired displacement or turn of the frame occurs, the travelling wheels will follow a slightly deviating path along the pipe surface, such path being intended to correct the detected displacement. Due to these provisions, the treatment apparatus is capable of keeping itself in balance at unequal distributions of auxiliary equipment, irregularities during movement in circumferential direction and inequalities in the pipe surface. Moreover, the treatment apparatus may pass curvatures in the pipe or the pipeline without trouble and may even perform ascending and descending movements then.

Further details of the invented treating apparatus will become apparent upon reading the figure description.

The invention is further illustrated by the drawings which show, by way of example, an embodiment of the invented treating apparatus in the form of an apparatus for removing a bituminous or other coating from a pipe surface.

Figure 1:
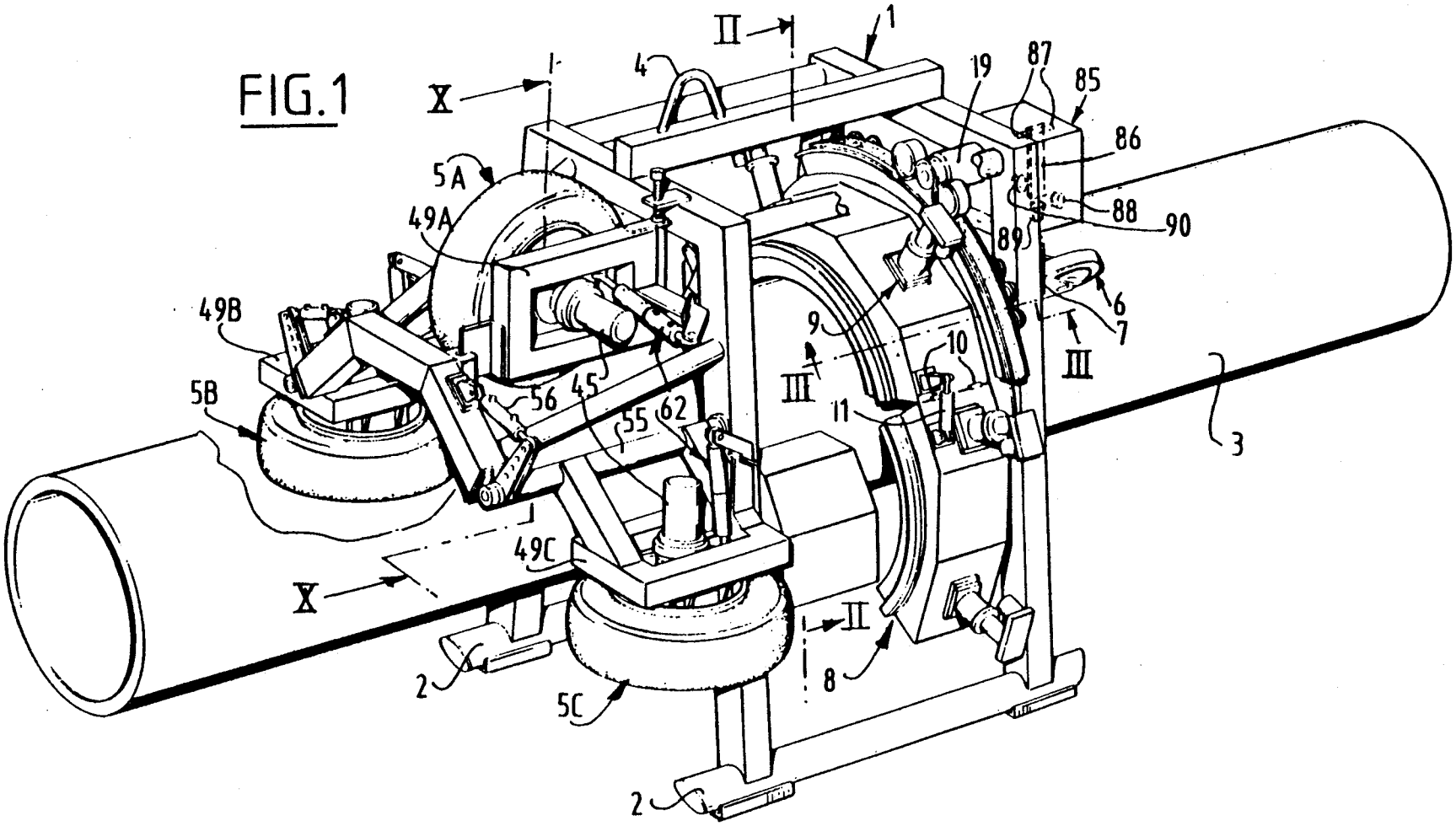
FIG. 1 is a perspective view of this embodiment.

The treatment apparatus of FIG. 1 has a frame 1 which is open from below and which may rest on the ground, if necessary, by means of a sledge 2. During operation, it is mounted around a pipe 3 to be treated.

Presuming that pipe 3 is an endless pipe, e.g. an exposed portion of a pipeline, frame 1 may be lifted easily by engaging an eye 4 thereon and may be lowered from above onto the pipe 3.

Frame 1 is resting on pipe 3 by means of two groups of travelling wheels 5A, 5B, 5C and 6, 6 which are further used for moving the frame along pipe 3 in longitudinal direction. Travelling wheels 6, 6 at the rear side are rotatably mounted in bearers 7, 7 which are part of frame 1.

An annular hood 8 carrying a plurality of nozzles 9, 9 is located within frame 1 and will extend with some clearance around pipe 3 during operation.

Figure 2:
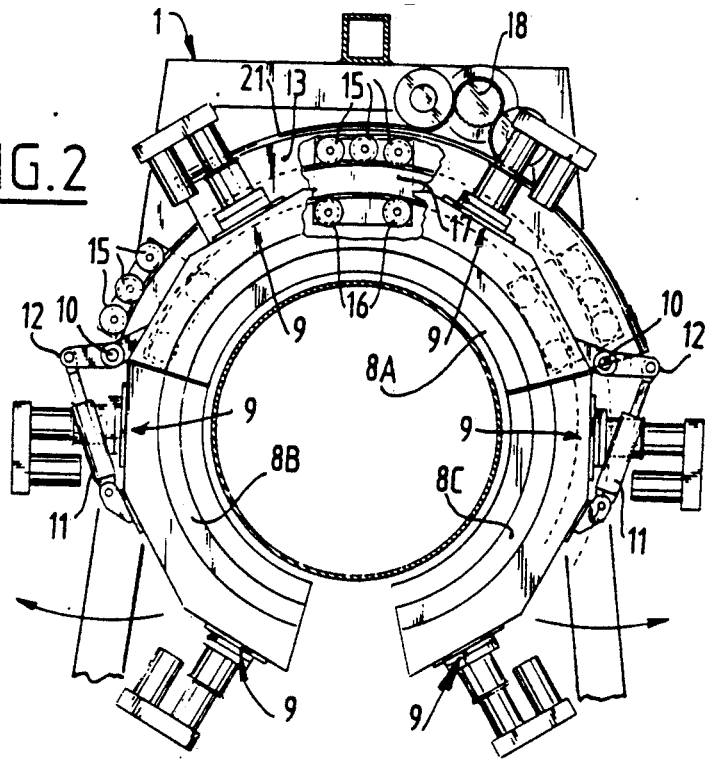
FIG. 2 is a view along the lines II—II of FIG. 1.

It can be seen from FIG. 2 that annular hood 8 has been made of segments 8A, 8B, 8C and that the lower segments 8B, 8C are connected to the upper segment 8A by means of hinges 10, 10. These lower segments 8B, 8C may be swung from their open position illustrated in FIG. 1 (where they are wide apart) to their closed position illustrated in FIG. 2 (where they surround the pipe) and vice versa, with the aid of hydraulic cylinders 11, 11 and levers 12, 12.

Figure 3:
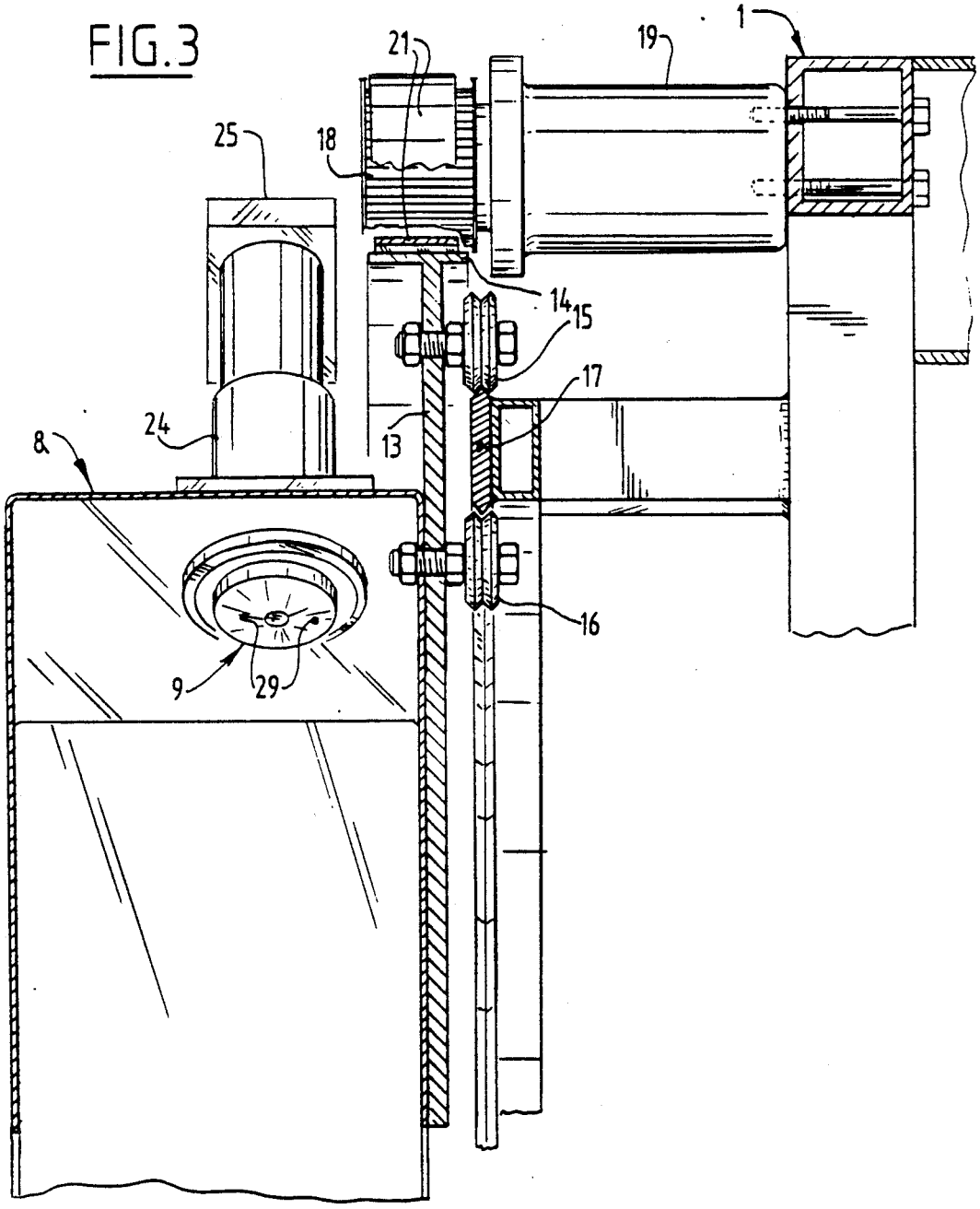
FIG. 3 is a cross-section and partial side view along the lines III—III of FIG. 1.

According to FIG. 3, a side plate 13 having the shape of a ring segment and provided with a flange 14, is connected to the upper segment 8A of hood 8. This side plate is mounted freely rotatable in frame 1 by means of upper and lower rollers 15, 15 and 16, 16 and a stationary rail 17 in ring segment form. The side plate 13 is driven for reciprocating rotation by means of a dentated driving roller 18 on the shaft of a driving engine 19 and by a belt 21 passing over this driving roller 18 and fixed to the ends 20, 20 of flange 14. In this way, hood 8 with nozzles 9, 9 may obtain an oscillatory movement in circumferential direction of pipe 3.

Figure 4:
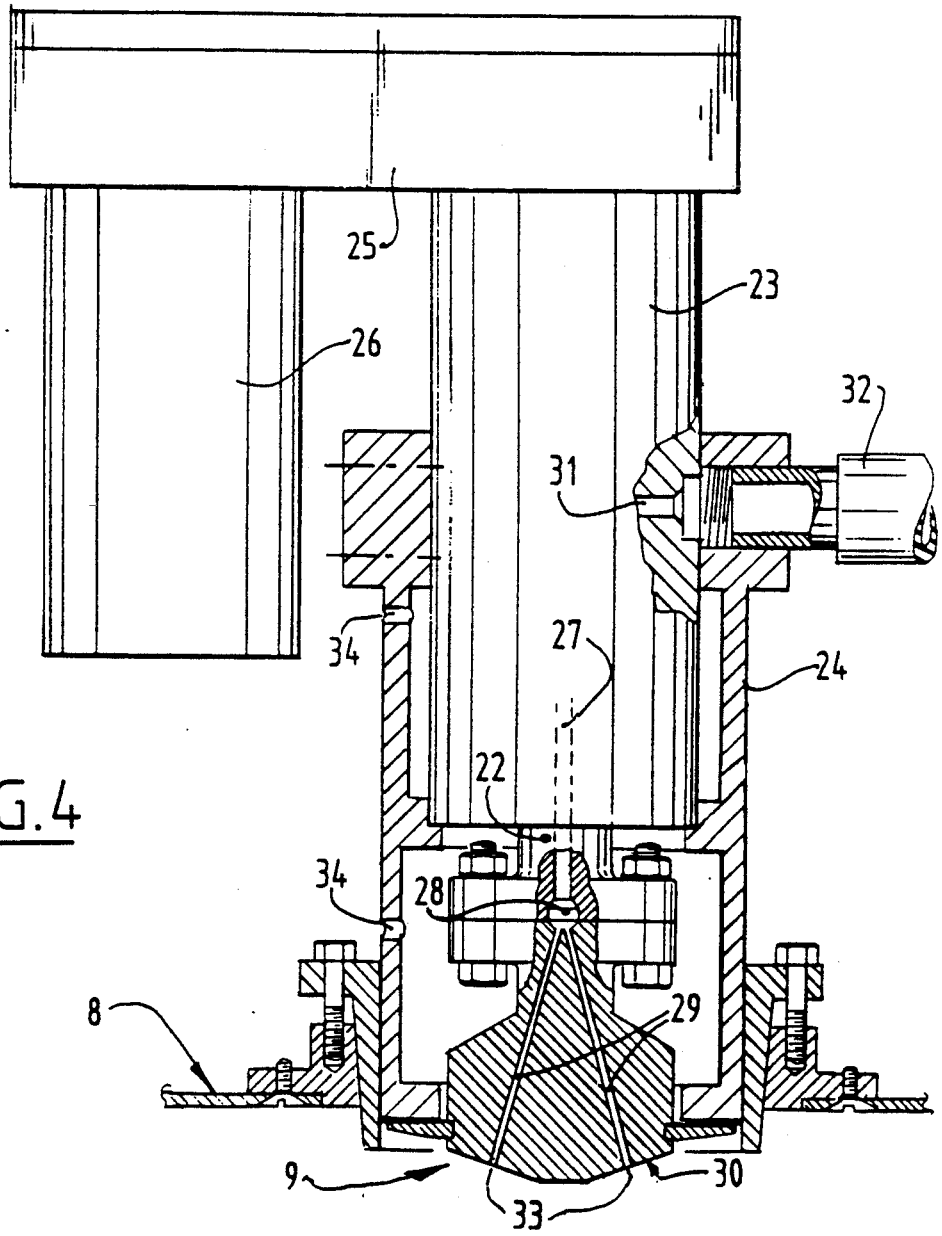
FIG. 4 shows one of the nozzles of the apparatus of FIG. 1 on a larger scale and partially in section.

The construction of nozzles 9, 9 is better shown in FIG. 4. Each nozzle 9 has been fixed to a shaft 22 which is rotatably mounted in a two-part housing 23, 24 fixed on hood 8 and which is driven by an engine 26 through a transmission 25.

Shaft 22 has a central longitudinal bore 27 which via a chamber 28 is connected with two diverging bores 28, 29 in nozzle 9, such bores having diametrically opposite mouths at the outer surface 30 of nozzle 9. Further, the longitudinal bore 27 within shaft 22 is connected with a cross-bore 31 within the housing 23, 24, said cross-bore being connected to a source of pressurized water by means of a hose 32.

During operation, each nozzle 9 will rotate about its axis with the aid of engine 26 and will at the same time discharge two powerful water jets which hit the pipe surface to be treated under an acute angle.

Figure 6:
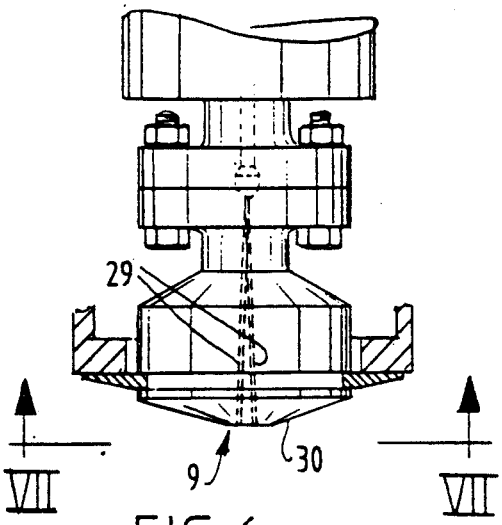
FIG. 6 is a partial side view of the nozzle of FIG. 4.
Figure 7:
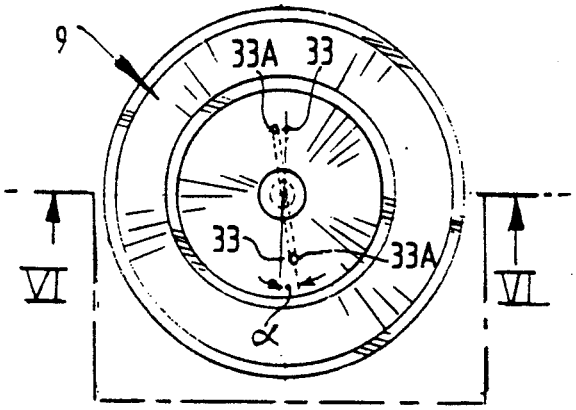
FIG. 7 is a bottom view along the lines VII—VII of FIG. 6.
Figure 5:
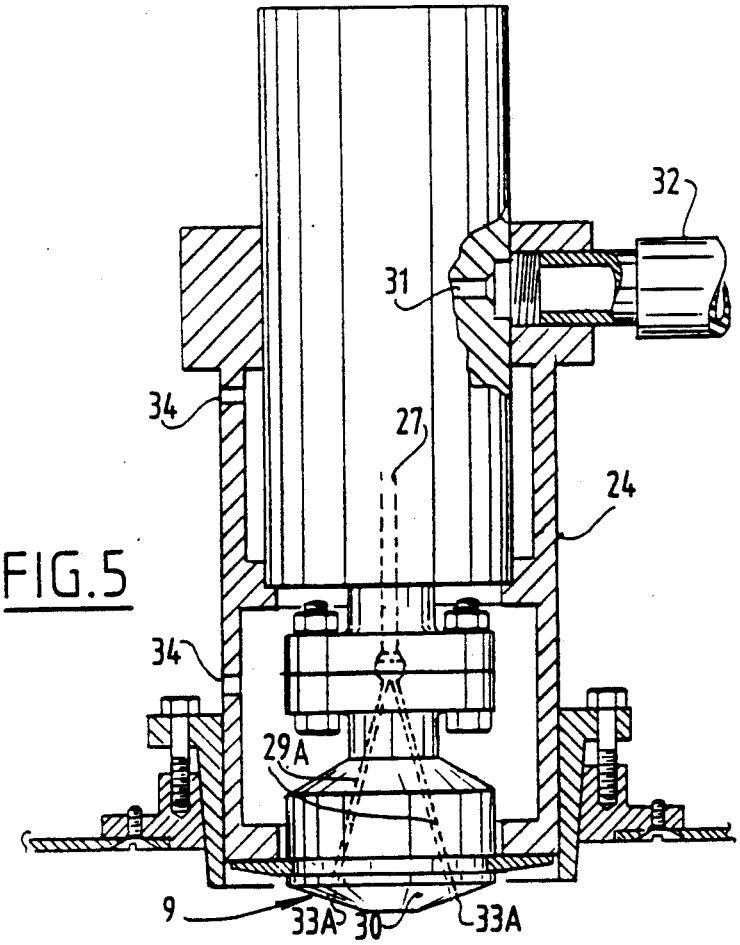
FIG. 5 shows a variant to the nozzle of FIG. 4.

An alternative construction wherein driving engine 26 has been omitted and the rotation of nozzle 9 is effected only by means of the powerful water jets is shown in FIGS. 5–7. In this construction, bores 29A, 29A within nozzle 9 are no longer in a single flat plane such as bores 29, 29 of FIG. 4, but their paths are more or less helical and their mouths 33A, 33A at the outer surface 30 of nozzle 9 are offset along an angle with regard to the mouths 33, 33 of bores 29, 29 (FIG. 7). If pressurized water is passed now through bores 27, 29A, 29A and if this water leaves the surface 30 of nozzle 9 in the form of powerful water jets, nozzle 9 will obtain a rotary movement under influence of reaction forces.

Provisions have been made with each nozzle 9 to allow the water supplied through hose 32 to flow away if the bores within nozzle 9 should become blocked up. Such provisions comprise e.g. escape holes 34, 34 in housing 24.

Figure 8:
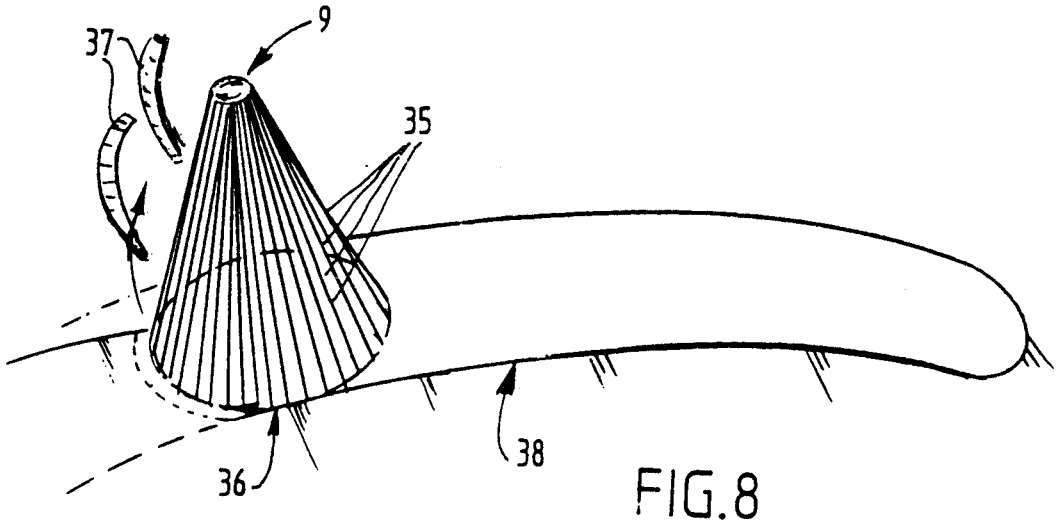
FIG. 8 shows one of the nozzles of the apparatus of FIG. 1 in operation.

It can be seen in FIG. 8 that the water jets 35 discharged by a rotating nozzle 9 are located on a conical surface which has an annular tangent plane 36 with the surface of the pipe to be treated. (The annular tangent plane 36 is not exactly circular in shape but slightly extended in consequence of the curvature of the pipe surface). These water jets are powerful enough to cut off and remove scales 37, 37 of a coating on the pipe surface at the location of tangent plane 36, even if that coating is composed of fibre webs impregnated with bituminous material.

Figure 9:
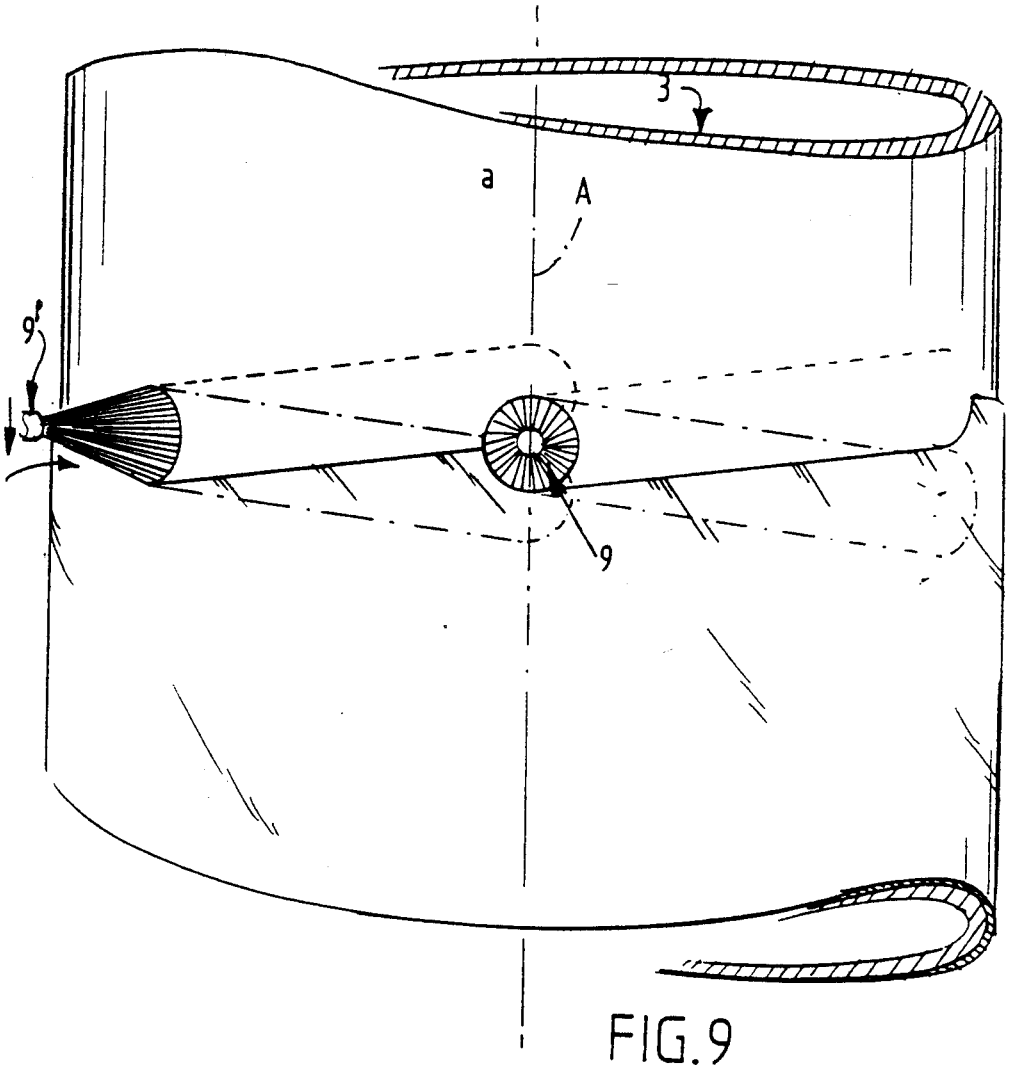
FIG. 9 shows the path of the nozzles along the pipe surface to be treated.

Due to the oscillating movement of hood 8 carrying nozzles 9, in circumferential direction of pipe 3, nozzle 9 and the annular tangent plane 36 will move over some distance in circumferential direction along the pipe surface, thus allowing the coating material to be removed along a strip 38. Thereupon, nozzle 9 and tangent plane 36 will move in reverse direction over the same distance. The path of nozzle and tangent plane during this reverse movement will not exactly coincide with their path during outward movement, because a movement of frame 1 with hood 8 and nozzles 9 in longitudinal direction of pipe 3 is effected at the same time. Due to these co-operating movements, the water jets from nozzle 9 will generally describe a zigzag path along the pipe surface having the longitudinal axis 39 of the pipe as a main direction (FIG. 9). The water jets from an adjacent nozzle 9' describe a similar zigzag path which partially overlaps the first mentioned zigzag path (FIG. 9). Thus, the pipe surface may be completely freed of a bituminous or other coating in longitudinal and circumferential direction.

The construction of travelling wheels 5A, 5B, 5C will now be described with reference to FIGS. 10–12. Each of these travelling wheels has a hub 40, a rim 41 and a pneumatic tyre 42, the hub 40 being secured to a wheel shaft 43 which is mounted rotatably in the housing 44 of an engine 45. Coupled to housing 44 is a ring 46 which carries two diametrically oposite journals 47, 47 on its outer side. Journals 47, 47 are rotatably mounted in support arms 48, 48 extending laterally from a rectangular supporting frame 49.

Supporting frame 49A of the upper travelling wheel 5A has been secured to frame 1 and is adjustable in height therein by means of lateral guides 50, 51, a screw spindle 52, slots 53 and matching bolts 54.

Contrary thereto, the supporting frames 49B, 49C of travelling wheels 5B, 5C are secured to horizontal beams 55, 55 which are rotatably mounted in frame 1. They may be swung from their open position shown in FIG. 1, wherein the travelling wheels 5B, 5C are wide apart, to their closed position shown in FIG. 10, wherein the travelling wheels 5B, 5C engage pipe 3, and vice versa, by means of hydraulic cylinders 56, 56 and levers 57, 57.

It should be noted that piston rods 58, 58 of cylinders 56, 56 engage levers 57, 57 by means of pins 59, 59 and holes 60, 60 and further, that each lever 57 carries a series of holes 60, 60. This will permit variations in the stroke of the swinging movement of supporting frames 49B, 49C in such a way that travelling wheels 5B, 5C in their closed position will always engage pipe 3, even at varying diameters of pipe 3 (indicated with dotted lines 3' in FIG. 10). The adjustability in height of supporting frame 49A serves the same purpose. Further, a fine adjustment of the position of travelling wheels 5A, 5B, 5C can be realized by controlling the air pressure in pneumatic tyres 42, 42, 42.

Figure 10:
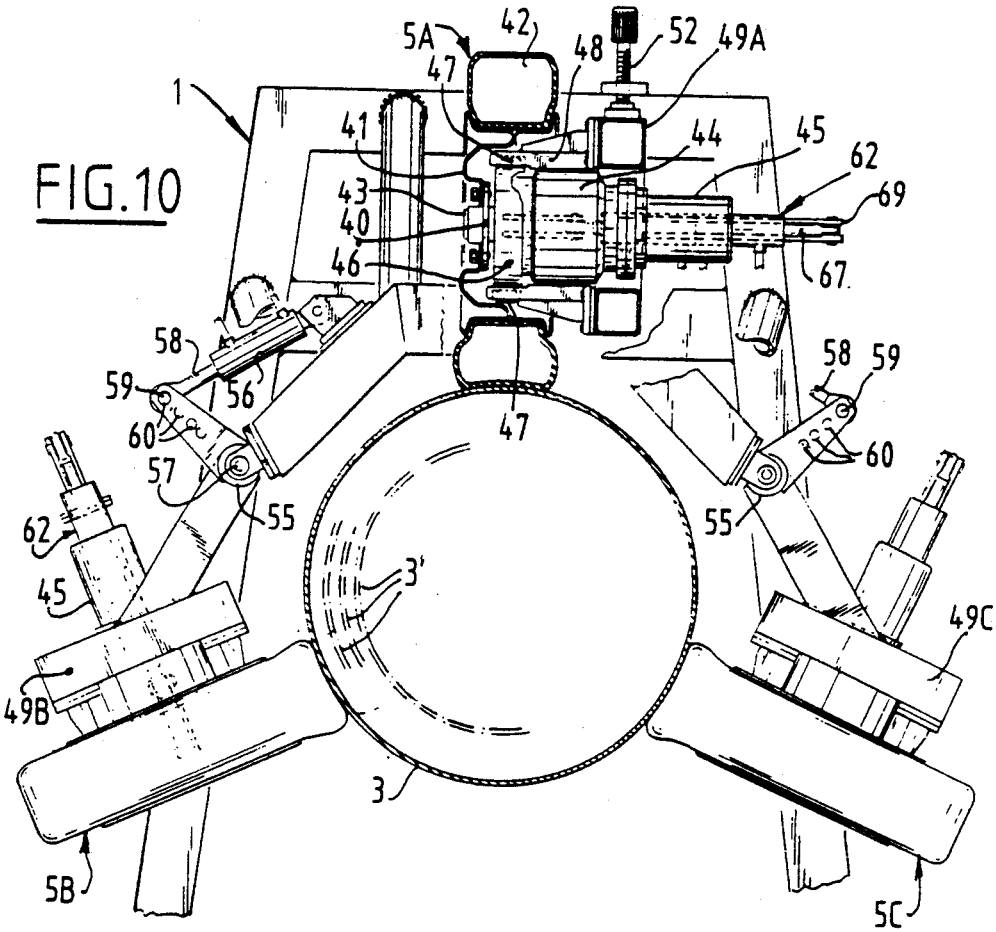
FIG. 10 is a section through the treating apparatus taken along the lines X—X of FIG. 1.
Figure 11:
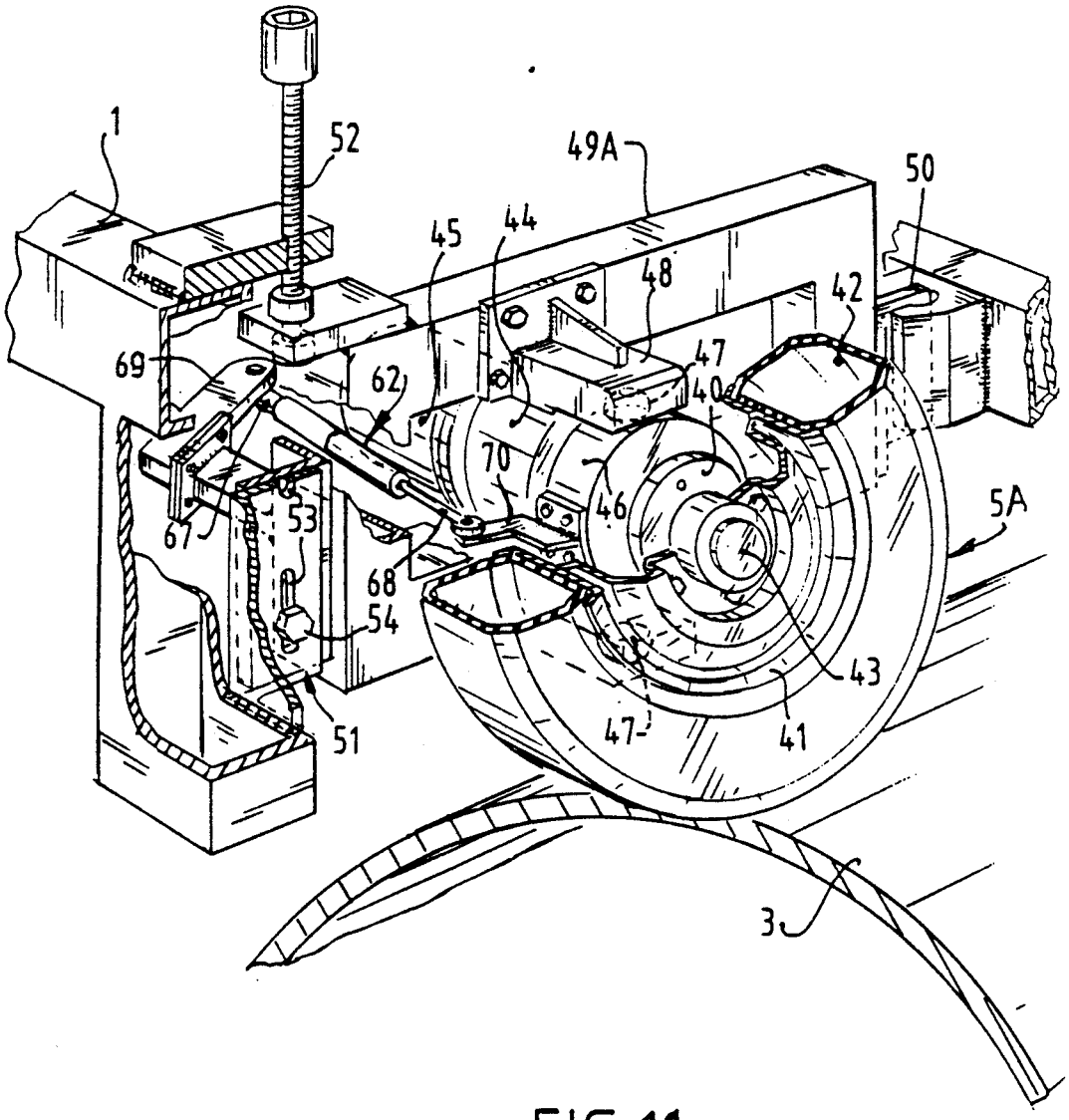
FIG. 11 is a perspective view with some parts being partially removed, showing the suspension of one of the travelling wheels of the apparatus of FIG. 1.

Further, a double hydraulic cylinder 62 enabling the wheel axis 43 of a travelling wheel 5 to be adjusted in angular position is mounted in the vicinity of each supporting frame 49 (FIG. 10, 11). According to FIG. 12, this double cylinder 62 comprises a cylindrical housing 63 with partition 64 and further two pistons 65, 66 with piston rods 67, 68. According to FIG. 11, piston rod 67 is coupled pivotably to a support arm 69 mounted in frame 1 and piston rod 68 is coupled pivotably to a support arm 70 secured to ring 46 of a travelling wheel 5. As a result thereof, adjustment of the wheel axis 43 of travelling wheel 5 may be effected in a plane parallel to the longitudinal direction of the pipe 3 to be treated.

Figure 12:
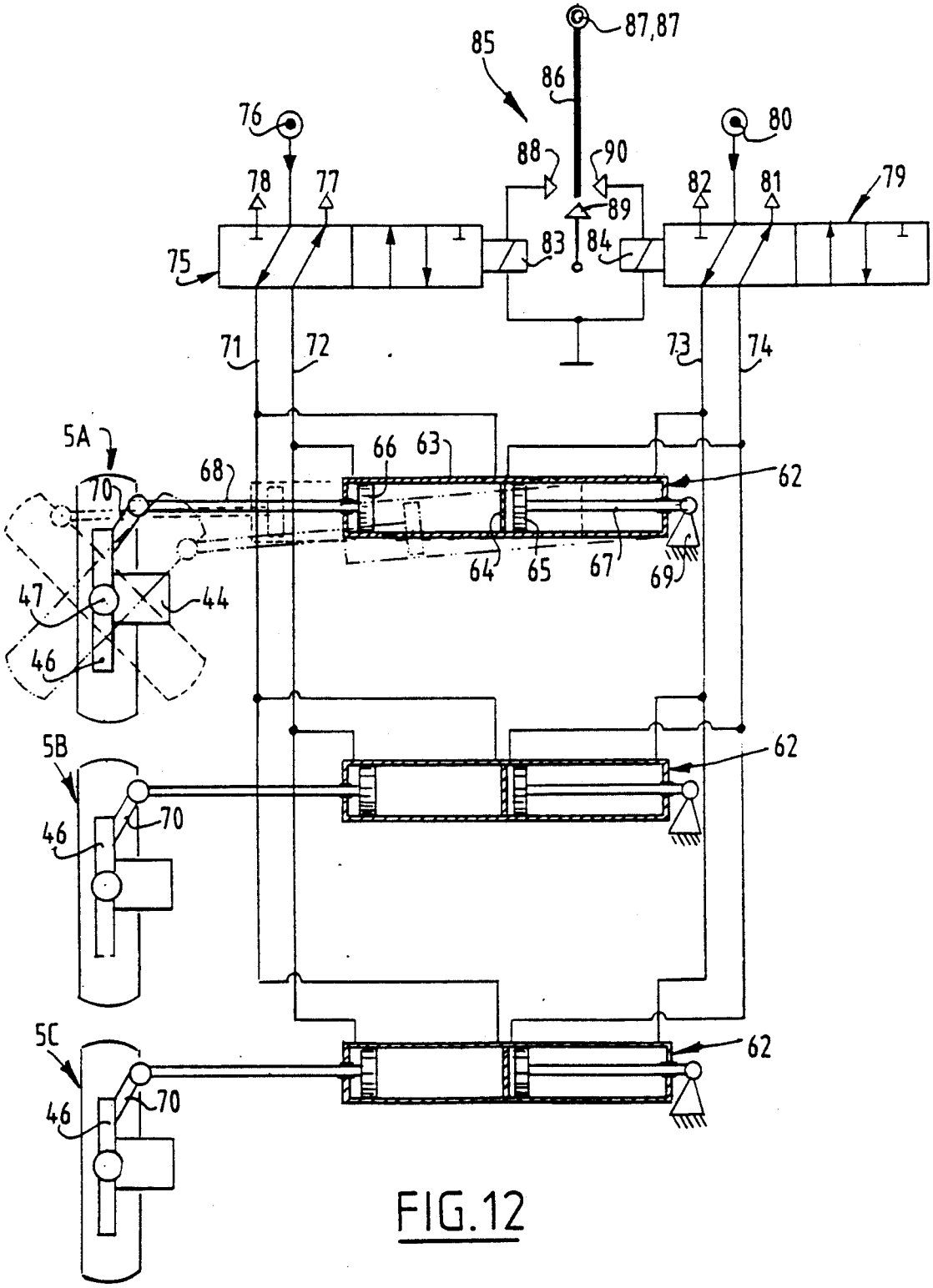
FIG. 12 is a schematic illustration of operation of the control means for the travelling wheels in the apparatus of FIG. 1.

The hydraulic actuating system is common to all cylinders 62, 62, 62 and comprises hydraulic lines 71, 72 for actuating pistons 65, 65, 65 and separate hydraulic lines 73, 74 for actuating pistons 66, 66, 66 (FIG. 12). Lines 71, 72 may be connected optionally to an inlet 76 and an outlet 77, or else to an outlet 78 and an inlet 76 of hydraulic fluid by means of a valve 75. Similarly, hydraulic lines 73, 74 may be connected optionally to an inlet 80 and an outlet 81 or else to an outlet 82 and an inlet 80 of hydraulic fluid by means of a valve 79. Valves 75 and 79 are actuated by magnetic coils 83, 84.

A detection device 85 for detecting undesired displacements of the frame in circumferential direction of pipe 3 is located in a suitable part of frame 1 (compare FIG. 1). This detection device 85 comprises here a pendulum 86 suspended for free swinging movement by means of journals 87, 87 and capable of swinging in a plane perpendicular to the axis of the pipe to be treated and moreover three sensors 88, 89, 90 positioned in the path of the pendulum and capable of delivering signals to valves 75 and 79 of the hydraulic system.

The way of functioning of detection device 85 and hydraulic cylinders 62, 62, 62 is shown in FIG. 12. Supposed that frame 1 of the apparatus is in balance on pipe 3, pendulum 86 of the detection device will occupy an intermediate position (zero-position) and will only energize central sensor 89. In that case, the position of valves 75, 79 is such that hydraulic lines 71 and 73 are connected to inlets 76, 80 of hydraulic fluid and that pistons 65, 65, 65 as well as pistons 66, 66, 66 are located at one side (the left side in FIG. 12) of cylinders 63, 63, 63. Travelling wheels 5A, 5B, 5C will occupy the position shown in full lines and wheel axes 43, 43, 43 will be positioned perpendicular to the longitudinal direction of pipe 3.

As soon as frame 1 is subjected to an undesired displacement in circumferential direction of pipe 3 under influence of certain factors, pendulum 86 will travel outwards. Should the amount of travel be sufficiently high to cause activation of one of the sensors 88 or 90 by the pendulum, then the hydraulic cylinders 62, 62, 62 are put in operation to correct the displacement that has occurred.

If sensor 88 is activated by pendulum 86, magnetic coil 83 is operated to activate valve 75. As a result thereof, the supply and drain of hydraulic fluid to and from lines 71 and 72 will be reversed, causing pistons 66, 66, 66 to move to the right and causing the wheel axes of travelling wheels 5A, 5B, 5C to be adjusted such that these travelling wheels will occupy the position indicated with mixed lines. Frame 1 will follow a somewhat deviating path along pipe 3 then and the undesired displacements of the frame in circumferential direction will be annulled.

If sensor 90 is activated by pendulum 86, coil 84 is operated to actuate valve 79. As a result thereof, the supply and drain of hydraulic fluid to and from lines 73 and 74 are reversed, causing the cylinder housings 63, 63, 63 to move to the left and causing an adjustment of the wheel axes of travelling wheels 5A, 5B, 5C in such a way that these travelling wheels will occupy the position indicated with dotted lines. In this case as well, frame 1 will follow a slightly deviating path along pipe 3 and the undesired displacement of the frame in circumferential direction will be corrected.

As soon as the position of frame 1 is corrected, pendulum 86 of the detection device 85 will swing back to its intermediate position and will activate central sensor 89 to cause a return of valve 75 or 79 to its initial position. As a result thereof, travelling wheels 5A, 5B, 5C return to their initial position and the balance of the frame is restored.

Thus, the apparatus of FIG. 1 is capable to keep itself in balance on pipe 3 during operation, due to detection device 85 and the hydraulic cylinders 62, 62, 62. Inequalities in the pipe surface as well as irregularities in movements of certain parts may be compensated well in this way. Further, the apparatus is capable of moving along curvatures in the pipe without provision of additional measures and also to follow an ascending or descending path along the pipe.

Figure 13:
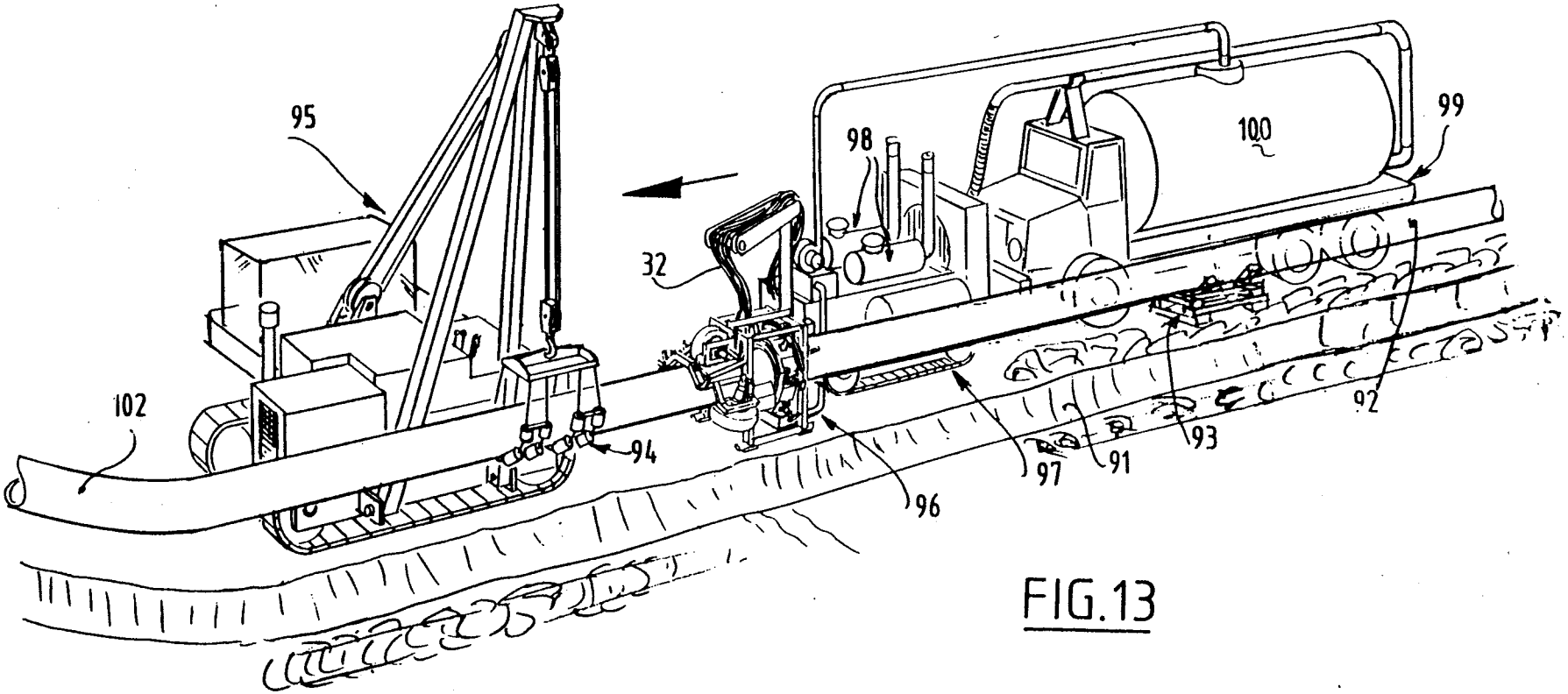
FIG. 13 shows the apparatus of FIG. 1 in operation during treatment of a pipeline.

FIG. 13 shows the apparatus of FIG. 1 in operation during treatment of the exterior surface of a pipeline. It is presumed that the pipeline has been resting in the ground for a long time and that a bituminous or other coating at the surface should be removed and replaced by a fresh coating. To this end, after cutting off liquid flow through the pipeline, the steps of digging a trench 91 around the pipeline, next cutting off a pipeline section 92 of considerable length (e.g. about 300 meters), lifting this pipeline section from the trench and positioning it by the side of the trench 91 at some meters above ground level, have been performed. Stationary supports 93 as well as a movable support 94, the latter being carried by a travelling crane 95, have been used therein.

In addition to travelling crane 95, a treating unit 96 according to FIG. 1, a vehicle 97 carrying a pumpset 98 and drawn by crane 95, and a truck 99 carrying a water supply tank 100 are positioned alongside pipeline section 92.

At the start of the operation, treating unit 96 is lifted and positioned onto pipeline section 92. Next, the lower travelling wheels 5B, 5C and the lower segments of hood 8, which were in open position, are swung to their closed positions. Thereupon, the various driving means for causing rotation of nozzles 9, an oscillating movement of hood 8 and a conveying movement of unit 96 along pipeline section 92 are simultaneously put in operation by actuating means on vehicle 97. Crane 95, vehicle 97 and truck 98 will travel together with treating unit 96 along pipe section 92. The water required for nozzles 9 is contained in tank 100 of truck 99 and is supplied through pumpset 98, a distribution system 101 and hoses 32 to the nozzles 9 of unit 96, where it is directed against the exterior surface of pipeline section 92 in the form of powerful water jets.

The water jets emerging from each nozzle will only cover a small annular area of the pipe surface at the location of that nozzle. Nevertheless, the whole pipe surface can be treated with a limited number of nozzles since the nozzles will describe a zigzag path along the surface of the pipeline, having the longitudinal direction of the pipeline as main direction, as a result of an oscillating movement in circumferential direction and a continuous movement in longitudinal direction. In this way, a pipeline section 92 of considerable length may be freed of a bituminous or other coating in continuous operation.

Should a horizontal curvature 102 be present in the pipeline section 92 to be treated, then such curvature will not be inconvenient since unit 96 will keep itself always in balance during passage of the curvature 102, due to the fact that the wheel axes of the travelling wheels in unit 96 are automatically adjustable with the aid of detection device 85 and hydraulic cylinders 62, 62, 62.

Treating unit 96 may be followed at a suitable distance by an apparatus (not shown) for examining the exposed pipe surface and by an apparatus (not shown as well) for applying a fresh coating onto that surface, e.g. by winding, extruding or spraying a coating material onto it.

It has been presumed in FIG. 13 that a pipe section of considerable length is cut off from the pipeline and positioned alongside trench 91. Instead thereof, it is also conceivable that the pipeline will remain in situ and that the liquid flow through that pipeline is not interrupted. In that case, the pipeline is supported within trench 91 and treating unit 96 is applied onto the pipeline in the trench. Even then, a horizontal or perhaps vertical curvature in the pipeline will not be inconvenient because treating unit 96 will be automatically kept in balance by means of detection device 85 and hydraulic cylinders 62, 62, 62.

In the case of pipes or tubes of short lengths, it is possible to install the treating apparatus of FIG. 1 in a stationary position and then to insert the pipe or tube with one of its ends into the apparatus of FIG. 1. During operation, the pipe or tube will be conveyed in longitudinal direction through the treating apparatus, due to the travelling wheels 5A, 5B, 5C.

Several variants to the embodiment of FIG. 1 to 12 as disclosed are possible. Thus, it may be that the upper travelling wheel 5A of the apparatus is not provided with a pneumatic tyre but with a solid tyre in order to get a better grip onto pipe 3.

Central sensor 89 of detection device 85 may be replaced, if desired, by two sensors adjusted in such a way that only the last-met sensor of both will be activated during a swing-back movement of pendulum 86. By this provision, the correction of displacements may be effected more smoothly.

If desired, pendulum 86 may be suspended cardanically by means of a pivotable supporting frame. In that case, the supporting frame is mounted to the frame and pivotable around a horizontal axis transversely to the longitudinal axis of the pipe 3 to be treated. Functioning of the detection device is made easier thereby. Further, the pendulum might be executed as an electronic level device.

While the apparatus of FIG. 1 has been described as an apparatus for removing bituminous or other coatings from a pipe surface, it will be clear that the same apparatus may also be used for spraying coatings onto such surface and even for sand blasting. Further, the system disclosed for adjusting the wheel axes of travelling wheels may also be used in winding machinery for the application of impregnated fiber webs and generally in any apparatus for treating a pipe surface which has a frame to be mounted around the pipe and means for moving that frame along the pipe in longitudinal direction.

I claim:

1. Apparatus for treating an exterior pipe surface, comprising a frame adapted for being mounted around the pipe to be treated; means therein for treating the pipe surface; and means in the form of travelling wheels for moving the frame in longitudinal direction along the pipe surface, characterised by means for detecting undesired displacements of the frame in circumferential direction of the pipe, and control means for adjusting the wheel axes of one or more travelling wheels in angular position, in response to a signal delivered by the detection means.

2. Apparatus as claimed in claim 1, wherein the detection means are arranged to deliver a signal only at a predetermined magnitude of the detected displacement.

3. Apparatus as claimed in claim 1 or 2, wherein the detection means comprise a pendulum suspended for free swinging movement and at least three sensors positioned in spaced relationship in the path of the pendulum.

4. Apparatus as claimed in claim 1, wherein the control means are arranged to adjust the wheel axes of the travelling wheels in planes parallel to the longitudinal direction of the pipe to be treated.

5. Apparatus as claimed in claim 1 or 4, wherein the control means comprise hydraulic cylinders having a common system of hydraulic lines and valves.

* * * * *